US006695602B2

(12) United States Patent
Sundström et al.

(10) Patent No.: US 6,695,602 B2
(45) Date of Patent: Feb. 24, 2004

(54) BACTERIAL GROWTH INHIBITION IN A CIRCULATION SYSTEM COMPRISING A COMPRESSOR

(75) Inventors: Mats Sundström, Ingarö (SE); Karlis Timuska, Stockholm (SE); Henrik Öhman, Täby (SE)

(73) Assignee: Svenska Rotor Maskiner AB, Stockholm (SE)

( * ) Notice: Subject to any disclaimer, the term of this patent is extended or adjusted under 35 U.S.C. 154(b) by 0 days.

(21) Appl. No.: 10/204,571

(22) PCT Filed: Mar. 13, 2001

(86) PCT No.: PCT/SE01/00516

§ 371 (c)(1),
(2), (4) Date: Aug. 21, 2002

(65) Prior Publication Data

US 2003/0059328 A1 Mar. 27, 2003

(30) Foreign Application Priority Data

Mar. 30, 2000 (SE) ..... 0001126

(51) Int. Cl.[7] ..... F04C 29/04

(52) U.S. Cl. ..... 418/84; 418/85; 418/97; 418/201.1; 418/1; 417/228; 184/6.16

(58) Field of Search ..... 418/84, 85, 97, 418/DIG. 1, 201.1, 1; 417/228; 184/6.16

(56) References Cited

U.S. PATENT DOCUMENTS 3,747,404 A * 7/1973 Novak ..... 418/DIG. 1
3,785,755 A * 1/1974 Novak et al. ..... 418/85
4,289,461 A * 9/1981 van Oorschot et al. ..... 418/85
4,968,231 A 11/1990 Zimmern et al.
5,174,741 A * 12/1992 Tohgo ..... 418/84
5,318,151 A * 6/1994 Hood et al. ..... 184/6.16
6,082,982 A * 7/2000 Rosser et al. ..... 184/6.16
6,102,683 A 8/2000 Kirsten
6,149,408 A * 11/2000 Holt ..... 418/85

* cited by examiner

*Primary Examiner*—Thomas Denion
*Assistant Examiner*—Theresa Trieu
(74) *Attorney, Agent, or Firm*—Frishauf, Holtz, Goodman & Chick, P.C.

(57) ABSTRACT

The present invention relates to a compressor (1) that has an associated coolant circulation system (1, 4, 6, 8, 11, 13), and also to a method of maintaining a low bacteria content in the coolant circulating system (1, 4, 6, 8, 11, 13), in which method gas and coolant are supplied to the compressor (1) during running of the system and the gas is compressed in the compressor (1) to an outlet pressure, the gas and the coolant are removed together from the compressor (1) and then separated into a respective gas and a liquid phase, whereafter the gas is passed to a recipient and the liquid is cooled before being returned to the compressor as coolant. The method is characterized by creating bacteria-killing conditions intermittently in the system by appropriating the heat-generating capacity of the compressor (1) to raise the temperature of the circulating coolant to at least 55° C. for a duration of at least 15 seconds.

26 Claims, 1 Drawing Sheet

BACTERIAL GROWTH INHIBITION IN A CIRCULATION SYSTEM COMPRISING A COMPRESSOR

This application is a U.S. National Phase Application under 35 U.S.C. 371 of International Application No. PCT/SE01/00516 filed Mar. 13, 2001.

BACKGROUND OF THE INVENTION

The present invention relates to a method of maintaining a low bacterial content in a compressor that includes a coolant circulating system, wherewith operating gas and coolant are supplied to the compressor during running of the system and the gas is compressed to an outlet pressure, the gas and the coolant are removed together from the compressor and then separated into a gas and a liquid phase, whereafter the gas is passed to a recipient and the liquid is cooled before being returned to the compressor as coolant. The invention also relates to a compressor with an associated coolant circulating system, for maintaining a low bacteria content in the compressor.

Compressors intended for compressing air or some other gas that is then delivered to a recipient, such as a pressure gas system for example, are often cooled with a liquid coolant, e.g. water. This coolant comes into direct contact with the gas under compression. Normally at least some of the coolant is vaporised by the heat generated during compression. As a result, it is then necessary to subject the compressed coolant-containing gas to a gas-liquid separation process in order to recover the coolant. Moreover, it is also often desired that the gas will contain very little coolant, in other words that the amount of coolant present in the gas passed to the recipient is the least possible.

Typical coolants are oil and water. It is very much desired to establish in the coolant circulation system conditions in which bacteria are unable to flourish, particularly when the coolant is water and the gas is air. Bacterial growth will normally occur in particular in those parts of the circulation system in which the liquid has a low rate of flow or is stationary. The temperature prevailing in these parts of the system is also normally favourable to the growth of bacteria. Thus, there is obtained rapidly growing colonies of bacteria that form a slimy mass. Bacterial growth is normally exponential.

In order to ensure that the compressed gas (usually air) will not contain large quantities of bacteria subsequent to the liquid separation stage, it is therefore necessary to dispose of the bacteria colonies intermittently, before the colonies become too large. This removal can be achieved either by removing all the liquid present and replacing it with clean liquid or by continuously cleansing the liquid circulating in the system. Even when the coolant is water, it is still expensive to cleanse at least parts of the water circulating system and adding in the order of 40 litres of distilled or de-ionised water at relatively short intervals.

SUMMARY OF THE INVENTION

One object of the present invention is to provide a simple and effective method by means of which the growth of harmful bacteria in the coolant circuit of a compressor can be prevented.

Another object is to provide a compressor with a coolant system that is able to prevent or greatly reduce the growth of bacteria in the coolant circuit.

According to the present invention the ability of the compressor to generate heat is appropriated to raise the temperature of the coolant to a bacteria-killing level for a period of time sufficient to pasteurise the coolant. Delivery of the compressed gas to a recipient, e.g. the pressure gas system, is avoided during this time period and the gas is either passed to the surroundings or preferably returned to the gas inlet of the compressor. In this latter alternative, a large portion of the coolant that would otherwise have been lost is returned to the system. In order to attain the conditions which cause the temperature of the coolant to increase, it is necessary to reduce the extent to which the coolant is cooled in operation. Cooling of the coolant is ceased completely during this bacteria-killing process, so as to obtain the quickest possible increase in temperature to the level desired.

The temperature of the coolant is controlled with the aid of a temperature sensor disposed between the coolant cooling device, or heat exchanger, and the coolant inlet of the compressor or in the inlet itself.

Pasteurisation of the coolant can be initiated either automatically or manually. The actual pasteurisation process and the duration of said process can be controlled with the aid of appropriate control devices, such as with the aid of valves for example.

The former object is achieved in accordance with the invention with a method for maintaining a low bacteria content in a compressor that includes a coolant circulation system, wherein gas and coolant are delivered to the compressor during operation and the gas is compressed to an outlet pressure, wherein gas and coolant are removed together from the compressor and the gas and coolant then separated into a respective gas phase and a liquid phase, whereafter the gas phase is passed to a recipient and the liquid phase is cooled before being returned to the compressor as a coolant. The method is characterised by creating bacteria-killing conditions intermittently in the system, by virtue of utilising the heat-generating capacity of the compressor to raise the temperature of the circulating coolant to a temperature of at least 55° C. for a duration of at least 15 seconds.

Advantageous embodiments will be apparent from the accompanying dependent claims.

The latter object is achieved with a compressor that has an associated coolant circulation system and that includes a gas inlet, a coolant inlet separate from the gas inlet, and a common outlet for compressed-gas and coolant, and wherein the circulation system includes a separator which includes a gas/coolant inlet means, a gas phase outlet means, a liquid phase outlet means, a heat exchanger for lowering the temperature of the liquid phase, and conduits that connect the compressor outlet with the separator inlet, the liquid phase outlet of the separator with the heat exchanger, and the heat exchanger with the coolant inlet of the compressor. The inventive compressor is characterised in that it includes a temperature sensor in the coolant inlet of the compressor or in the coolant conduit that connects the heat exchanger with the coolant inlet of said compressor.

DETAILED DESCRIPTION

Figure 1:
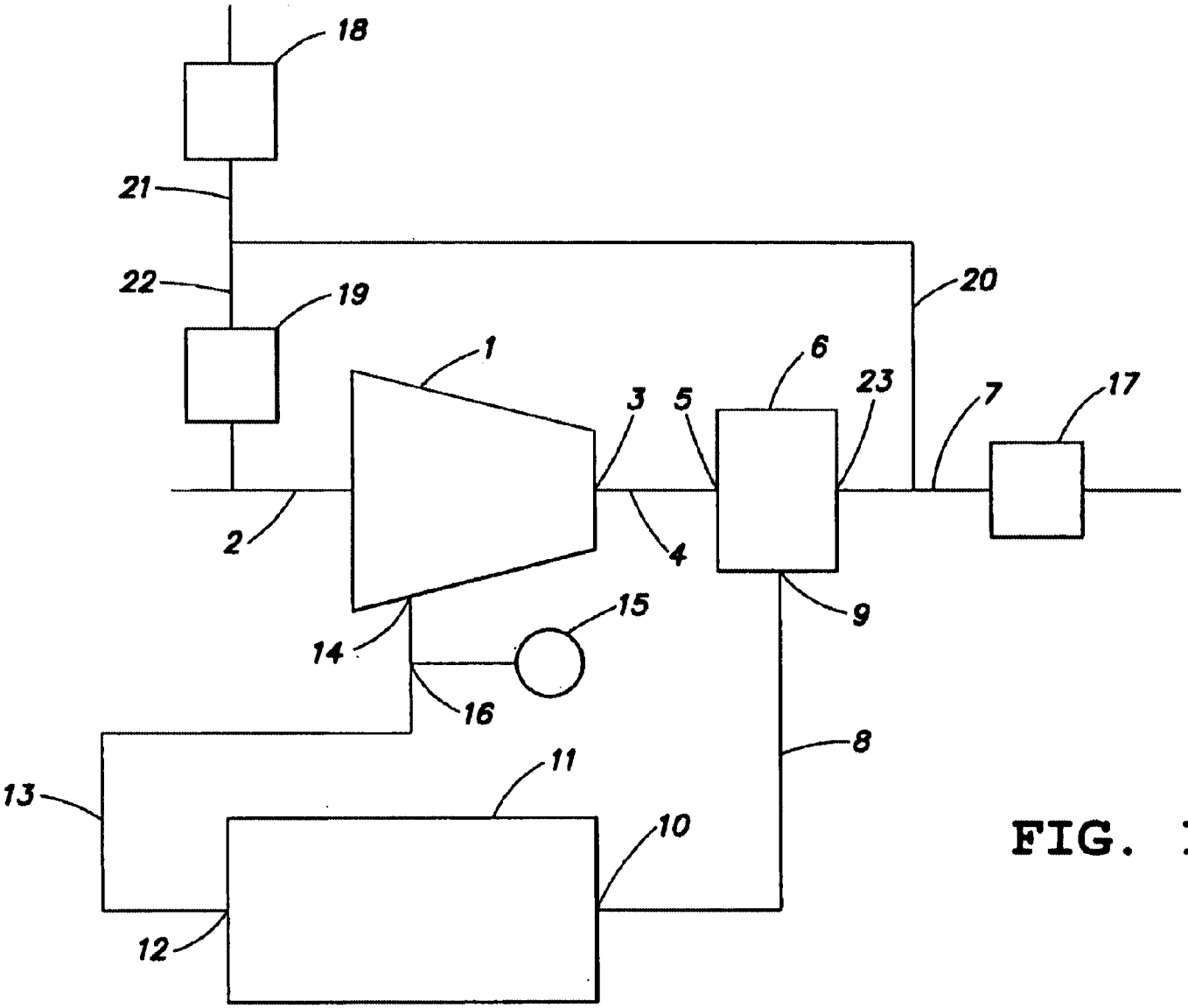
FIG. 1 is a schematic view of a compressor.

A compressor 1, preferably a helical screw compressor, includes an air inlet 2 and a compressed air outlet 3. The outlet 3 is connected to an inlet 5 of a liquid separator 6 via a conduit 4. The liquid separator 6 has a first outlet 23 which is connected to a conduit 7 for the transportation of air to a recipient (not shown). The conduit 7 includes a shut-off valve 17.

The separator 6 includes a second outlet 9 which is connected to an inlet 10 of a liquid phase cooling device 11, e.g. a heat exchanger, by means of a conduit 8. The outlet 12 of the cooling device 11 is connected to a conduit 13 which in turn connects the cooling device to a coolant inlet 14 of the compressor 1. In a preferred embodiment of the invention the compressor 1 is a helical screw compressor. The coolant inlet 14 of the compressor 1 opens into a closed compression chamber disposed at the beginning of the compression cycle. A temperature sensor 16 is disposed in the conduit 13, immediately upstream of the coolant inlet 14, said sensor being connected to a temperature registering or temperature indicating means 15. Alternatively, the sensor 16 may be placed in the coolant inlet 14 itself.

Extending from the conduit 7 upstream of the shut off valve 17 is a branch conduit 20 which, at its other end, branches into a first conduit 21 which opens out into the ambient atmosphere downstream of a valve 18, and into a second conduit 22 which pens into the compressor gas inlet 2. The second conduit 22 includes a valve 19.

When the compressor is running, the valves 18 and 19 are closed. Air is supplied to the compressor 1 through the air inlet 2 and leaves the compressor through the combined air/coolant outlet 3 and is conducted from there to the liquid separator 6, in which coolant (water) is separated from the gas (air). The air leaves the separator 6 through the first outlet 23 for transportation to a recipient (not shown) through the conduit 7 and the open valve 17. Because the valves 18 and 19 are closed, all air will pass to the recipient.

The separated water leaves the separator 6 through the second outlet 9 and is transported through the conduit 8 to the coolant cooling device or heat exchanger 11, in which it is cooled. The cooled water is transported through the conduit 13 to the coolant inlet 14 of the compressor 1 leading to a compression chamber that has just been cut-off from the inlet 2.

Bacteria that have grown and multiplied during operation of the compressor are killed by closing the valve 17 and opening either the valve 18 or 19. When the valve 18 is opened, the compressed air is released to atmosphere. On the other hand, the air is returned to the compressor when the valve 19 is opened. The killing process also involves reducing the extent to which water circulating in the cooler 11 is cooled, or preferably ceasing cooling altogether. The conduits 8 and 13 may alternatively be connected one to the other, so that the water will bypass the cooler 11. A drawback with this latter alternative is that bacterial growth in the cooler 11 will not be affected.

Because the heat generated by compression of the air is not cooled, the temperature of the water will rise. The water temperature is measured by the sensor 16 either in the conduit 13 adjacent the inlet to the compressor or in the compressor water inlet 14. When the temperature sensed by the sensor 16 has reached the desired temperature of at least 55° C. for a duration of at least 15 seconds, the pasteurisation process can be terminated and the system returned to normal operation. The temperature aimed for will preferably be at least 65° C. When reached, this temperature of 55° C. will be maintained for a duration of at least one minute.

The compressor referred to is preferably a helical screw compressor that has two mutually co-acting rotors with helical threads. The helical threads are preferably comprised of polymeric material, for instance polyurethane or copolymers that contain polyurethane. The polymeric material is preferably reinforced.

What is claimed is:

1. A method of maintaining a low bacteria content in a compressor that includes a coolant circulating system, wherein:

gas and coolant are supplied to the compressor during running of the system and the gas is compressed in the compressor to an outlet pressure, the gas and the coolant are removed together from the compressor and then separated into a gas phase and a liquid phase, the gas phase is passed to a recipient and the liquid phase is cooled before being returned to the compressor as coolant, and bacteria-killing conditions are intermittently created in the system by controlling the compressor to raise a temperature of the circulating coolant to at least 55° C. for a duration of at least 15 seconds.

2. A method according to claim 1, wherein the bacteria-killing conditions are intermittently created in the system by raising the coolant temperature to at least 65° C.

3. A method according to claim 2, wherein the bacteria-killing conditions are created by reduced cooling of the liquid phase.

4. A method according to claim 3, wherein the bacteria-killing conditions are created by returning the gas phase to the compressor inlet.

5. A method according to claim 4, wherein the gas is air and the coolant is water.

6. A method according to claim 3, wherein the gas phase is delivered to an alternative gas system different to said recipient.

7. A method according to claim 6, wherein the gas is air and the coolant is water.

8. A method according to claim 3, wherein the gas is air and the coolant is water.

9. A method according to claim 2, wherein the bacteria-killing conditions are created by returning the gas phase to the compressor inlet.

10. A method according to claim 9, wherein the gas is air and the coolant is water.

11. A method according to claim 2, wherein the temperature of the returned coolant is measured downstream of, immediately upstream of, or in the coolant inlet of the compressor.

12. A method according to claim 11, wherein the gas is air and the coolant is water.

13. A method according to claim 2, wherein the gas is air and the coolant is water.

14. A method according to claim 1, wherein the bacteria-killing conditions are created by reduced cooling of the liquid phase.

15. A method according to claim 14, wherein the bacteria-killing conditions are created by returning the gas phase to the compressor inlet.

16. A method according to claim 15, wherein the gas is air and the coolant is water.

17. A method according to claim 14, wherein the gas is air and the coolant is water.

18. A method according to claim 1, wherein the bacteria-killing conditions are created by returning the gas phase to the compressor inlet.

19. A method according to claim 18, wherein the gas is air and the coolant is water.

20. A method according to claim 1, wherein the temperature of the returned coolant is measured downstream of, immediately upstream of, or in the coolant inlet of the compressor.

21. A method according to claim 20, wherein the gas is air and the coolant is water.

22. A method according to claim 1, wherein the gas chase is delivered to an alternative gas system different to said recipient.

23. A method according to claim 22, wherein the gas is air and the coolant is water.

24. A method according to claim 1, wherein the gas is air and the coolant is water.

25. A compressor having an associated coolant circulation system wherein the compressor includes a gas inlet, a coolant inlet separate from the gas inlet, and a common outlet for coolant and compressed gas, wherein the circulation system includes a separator that has an inlet for gas and coolant, an outlet for gas phase and an outlet for liquid phase, a heat exchanger for lowering a temperature of the liquid phase, and respective conduits connecting each of (a) the compressor outlet to the separator inlet (b) the separator liquid-phase outlet to the heat exchanger, and (c) the heat exchanger to the coolant inlet of the compressor, and wherein the compressor further comprises a temperature sensor disposed in one of the coolant inlet of the compressor and the coolant conduit that connects the heat exchanger to the coolant inlet of the compressor, and means for temporarily raising the temperature of the coolant entering the compressor to at least 55° C.

26. A compressor according to claim 25, wherein the means for temporarily raising the temperature of the coolant entering the compressor to at least 55° C. comprises a valve in a line connecting the separator with the compressor inlet.

* * * * *